US007951332B2

(12) United States Patent
Cho et al.

(10) Patent No.: US 7,951,332 B2
(45) Date of Patent: May 31, 2011

(54) CENTRIFUGAL FORCE BASED MICROFLUIDIC DEVICE FOR DILUTION AND MICROFLUIDIC SYSTEM INCLUDING THE SAME

(75) Inventors: Yoon-kyoung Cho, Suwon-si (KR); Jeong-gun Lee, Seoul (KR); Beom-seok Lee, Hwaseong-si (KR); Jong-myeon Park, Seoul (KR); Young-sun Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 327 days.

(21) Appl. No.: 12/029,480

(22) Filed: Feb. 12, 2008

(65) Prior Publication Data

US 2008/0193336 A1 Aug. 14, 2008

(30) Foreign Application Priority Data

Feb. 12, 2007 (KR) ..... 10-2007-0014554

(51) Int. Cl.
*B01L 11/00* (2006.01)

(52) U.S. Cl. ..... 422/72; 422/502; 422/506; 422/68.1

(58) Field of Classification Search ..... 422/68.1, 422/72, 99, 100, 146, 50; 436/43, 45; 210/512.1; 494/23, 32, 33, 27, 29, 30
See application file for complete search history.

(56) References Cited

U.S. PATENT DOCUMENTS

| | | | | |
|---|---|---|---|---|
| 6,063,589 | A * | 5/2000 | Kellogg et al. | 422/68.1 |
| 6,582,662 | B1 * | 6/2003 | Kellogg et al. | 422/68.1 |
| 7,476,361 | B2 * | 1/2009 | Kellogg et al. | 422/72 |
| 2001/0055812 | A1 * | 12/2001 | Mian et al. | 422/72 |
| 2003/0152491 | A1 * | 8/2003 | Kellogg et al. | 422/72 |
| 2003/0156991 | A1 * | 8/2003 | Halas et al. | 422/100 |
| 2004/0203136 | A1 * | 10/2004 | Kellogg et al. | 435/287.2 |
| 2008/0058192 | A1 * | 3/2008 | Cho et al. | 494/1 |

* cited by examiner

*Primary Examiner* — In Suk Bullock
*Assistant Examiner* — Sharon Pregler
(74) *Attorney, Agent, or Firm* — Sughrue Mion, PLLC

(57) ABSTRACT

Provided are a centrifugal force based microfluidic device which can automatically perform a dilution operation and a microfluidic system including the same. The centrifugal force based microfluidic device for dilution includes a rotatable disk type platform, a mixing chamber disposed on the platform; a buffer solution storage disposed on a portion of the platform which is closer to a center of the platform than the mixing chamber, connected to the mixing chamber through a channel to supply a predetermined amount of buffer solution to the mixing chamber at least one time, and a plurality of diluted solution chambers which are disposed on a portion of the platform which is farther from the center of the platform than the mixing chamber, are each connected to the mixing chamber through flow paths extended from a middle exit corresponding to a predetermined water level, and sequentially receiving a solution which is serially diluted in the mixing chamber at least one time.

30 Claims, 12 Drawing Sheets

CENTRIFUGAL FORCE BASED MICROFLUIDIC DEVICE FOR DILUTION AND MICROFLUIDIC SYSTEM INCLUDING THE SAME

CROSS-REFERENCE TO RELATED PATENT APPLICATION

This application claims the benefit of Korean Patent Application No. 10-2007-0014554, filed on Feb. 12, 2007, in the Korean Intellectual Property Office, the disclosure of which is incorporated herein in its entirety by reference.

BACKGROUND OF THE INVENTION

1. Field of the Invention

The present invention relates to a centrifugal force based microfluidic device, and more particularly, to a microfluidic device which can automatically perform dilution of a sample in a microfluidic structure disposed on a disk type platform, and a microfluidic system including the microfluidic device.

2. Description of the Related Art

Generally, a microfluidic device has a structure including a chamber storing a minute amount of fluid, a channel through which the fluid flows, a valve for controlling flow of the fluid, and various functional units receiving the fluid to perform predetermined functions thereon. A biochip is obtained by arranging such a microfluidic device on a chip-type substrate and is used to analyse the performance of various assays including biologic reactions. In particular, a device that is designed to perform multiple step processes and manipulations using a single chip is referred to as a lab-on-a chip.

A driving pressure is generally required to transfer the fluid within a microfluidic device. Capillary pressure or a pressure generated by a specifically prepared pump is used as the driving pressure. A lab compact disk (CD) or a lab-on a disk is a recently-suggested microfluidic device obtained by arranging microfluidic structures on a compact disk-shaped platform and uses centrifugal force. However, in the case of a lab CD or a lab-on a disk, since a microfluidic structure is not fixed to a frame to revolve, a lab CD or a lab-on a disk is different from a lab-on-a chip, in which a microfluidic structure is fixed to the bottom, in various aspects.

Meanwhile, samples having various concentrations are largely required for chemical or biological experiments. A typical example of this is a calibration for cell counting or quantitative analysis of gene expression. U.S. Pat. Nos. 5,836,004 and 6,705,357 disclose devices which can provide samples having various concentrations on microfluidic chips. However, since electro-osmosis is used in U.S. Pat. No. 5,836,004, a high driving voltage is required. U.S. Pat. No. 6,705,357 cannot provide an exponential function type concentration gradient. In addition, it is difficult to embody the devices on a disk type platform.

Recently, as various centrifugal force based microfluidic devices, which can easily move fluid on a disk type platform, have been developed, there is a need for a device which can automatically provide samples having various concentrations on such a disk type platform.

SUMMARY OF THE INVENTION

The present invention provides a centrifugal force based microfluidic device for dilution which can provide samples having various concentrations without additional manual processes except for a process in which a sample is initially injected.

The present invention also provides a microfluidic system including the microfluidic device.

According to an aspect of the present invention, there is provided a centrifugal force based microfluidic device for dilution including a rotatable disk type platform; a mixing chamber disposed on the platform; a buffer solution storage disposed on a portion of the platform which is closer to a center of the platform than the mixing chamber, connected to the mixing chamber through a channel to supply a predetermined amount of buffer solution to the mixing chamber at least one time; and a plurality of diluted solution chambers which are disposed on a portion of the platform which is farther from the center of the platform than the mixing chamber, are each connected to the mixing chamber through flow paths extended from a middle exit corresponding to a predetermined water level, and sequentially receiving a solution which is diluted in the mixing chamber at least one time.

The microfluidic device may further include a sample storage disposed on a portion of the platform which is closer to the center of the platform than the mixing chamber, and which supplies a sample injected from the outside to the mixing chamber using a centrifugal force.

The buffer storage may include a metering chamber having a number of exit valves each of which is located corresponding to each of the number of water levels and is independently driven, and each of the water levels corresponds to n times a predetermined buffer volume, where n is a natural number.

The buffer solution storage may include a plurality of buffer chambers comprising exit valves each of which are independently driven, and each having the same volume.

A valve or a valve group, which is independently opened and closed the diluted solution chambers, may be installed in each of the flow paths connected from the middle exit of the mixing chamber to the diluted solution chambers.

The valve or the valve group may include a valve material in which a heating particle dispersed in a phase transition material dispersion medium which is solid at a room temperature, and a transition valve operated using an operation in which the valve material is melted by heat generated by electromagnetic waves emitted from an external energy source and moved, and the channel is opened and closed.

The valve group may include a pair of phase transition valves comprising a normally closed valve and a normally open valve.

The phase transition material dispersion medium may be at least one selected from the group consisting of wax, gel and a thermoplastic resin.

The diameter of the heating particle may be in the range of 1 nm to 100 μm.

The heating particle may be formed of at least one selected from the group consisting of a polymer bead, a quantum dot, an Au nanoparticle, an Ag nanoparticle, a bead with metal composition, a carbon particle and a magnetic bead.

According to another aspect of the present invention, there is provided a centrifugal force based microfluidic system including a microfluidic device for dilution comprising a rotatable disk type platform, a mixing chamber disposed on the platform, a buffer solution storage disposed on a portion of the platform which is closer to a center of the platform than the mixing chamber, connected to the mixing chamber through a channel to supply a predetermined amount of buffer solution to the mixing chamber at least one time, and a plurality of diluted solution chambers which are disposed on a portion of the platform which is farther from the center of the platform than the mixing chamber, are each connected to the mixing chamber through flow paths extended from a middle exit corresponding to a predetermined water level, and sequentially receives a solution which is diluted in the mixing chamber at least one time; a revolution driving unit revolve so as to support and control the microfluidic device; and a valve driving unit which independently drives a valve selected in the microfluidic device.

The valve driving unit may include an external energy source emitting an electromagnetic wave having a wavelength band such that heating particles in the valve are heated; and an external energy source controller controlling a location and a direction of the external energy source such that an electromagnetic wave emitted by the external energy source is intensively incident on a region corresponding to the selected valve.

The external energy source controller may include a straight moving unit moving the external energy source facing the platform of the microfluidic device in a radial direction of the platform.

The external energy source supplier may include a plane moving unit moving the external energy source facing the platform of the microfluidic device in two directions on a plane parallel to the platform with respect to rectangular coordinates.

The microfluidic system may further include a sample storage disposed on the platform, such that the sample storage is disposed closer to the center of the platform than the mixing chamber, and supplying a sample injected from the outside by a centrifugal force.

The buffer storage may include a metering chamber having a number of exit valves each of which is located corresponding to each of the number of water levels and is independently driven, and each of the water levels corresponds to n times a predetermined buffer volume, where n is a natural number.

The buffer solution storage may include a plurality of buffer solution chambers comprising exit valves, which are independently driven and have same volumes.

A valve or a valve group, which independently open and closes the diluted solution chambers, may be installed in each of the flow paths connected from the middle exit of the mixing chamber to the diluted solution chambers.

The valve or the valve group may include a valve material in which a heating particle dispersed in a phase transition material dispersion medium which is solid at a room temperature, and a transition valve operated using an operation in which the valve material is melted by heat generated by electromagnetic waves emitted from an external energy source and moved, and the channel is opened and closed.

The valve group may include a pair of phase transition valves comprising a normally closed and a normally open valve.

The phase transition material dispersion medium may be at least one selected from the group consisting of wax, gel and a thermoplastic resin.

The diameter of the heating particle may be in the range of 1 nm to 100 μm.

The heating particle may be formed of at least one selected from the group consisting of a polymer bead, a quantum dot, an Au nanoparticle, an Ag nanoparticle, a bead with metal composition, a carbon particle and a magnetic bead.

In this specification, a buffer solution is a solvent in which a sample is to be diluted, and a diluted solution is a mixed solution of the buffer solution and the sample. Serial dilution is an operation in which the sample and the buffer solution are diluted in a predetermined volume fraction, and then diluted solutions having various concentrations having an exponential functional relation are obtained while diluted solution and the buffer solution, which are diluted by a prior process, are repeatedly diluted several times.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art. Illustrated structures such as chambers and channels are simplified and exaggerated for clarity.

A flow path of this specification includes at least one channels as a path through which a fluid flows so as to connect chambers that are different from one another. In addition, an exit valve is a valve controlling out flow from one another. That is, the exit valve is a term relative to the location of a valve. A normally closed valve, a normally open valve and a reversible valve respectively are relative to the functions of phase transition valves according to embodiments of the present invention. Some valves may be both an exit valve and a normally closed valve. Valves having various shapes can be used as exit valves. For example, a normally closed valve using a phase transition material can be used as an exit valve.

Figure 1:
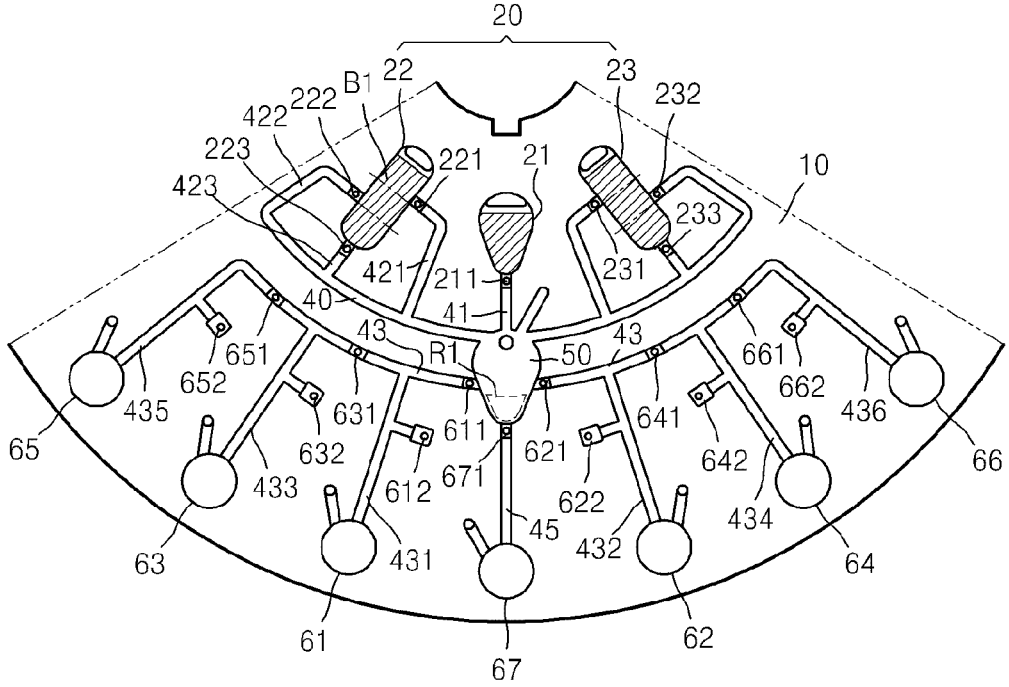
FIG. 1 is a plan view illustrating a centrifugal force based microfluidic device for dilution according to an embodiment of the present invention.

FIG. 1 is a plan view illustrating a centrifugal force based microfluidic device for dilution according to an embodiment of the present invention. Referring to FIG. 1, the microfluidic device according to the current embodiment of the present invention includes a platform 10 having a disk shape, a plurality of chambers 21 through 23, 50 and 61 through 67 disposed on the platform 10, a plurality of channels 40, 41, 43, 45 and 431 through 436 connecting the chambers 21 through 23, 50 and 61 through 67, and a plurality of valves 211, 221 through 223, 231 through 233, 611, 612, 621, 622, 631, 632, 641, 642, 651, 652, 661, 662 and 671 controlling the flow of fluid through the channels 40, 41, 43, 45, 431 through 436.

The platform 10 may be formed of a plastic material such as acryl or polydimethylsiloxane (PDMS) which are easy to mold and of which surfaces are inactive in terms of biology, but the present invention is not limited thereto. That is, the platform 10 may be formed of any material that has chemical and biological stability, optical transparency and mechanical processability. The platform 10 may be formed of plates in a plurality of layers. By forming engraved structures, which correspond to a chamber and a channel, on surfaces on which plates contact each other, and adhering the plates to each other, spaces and passages of the platform 10 may be provided inside the platform 10. The plates may be bonded to each other using adhesive, double-sided adhesive tape or ultrasonic fusion.

A mixing chamber 50 for mixing a sample and a buffer solution is disposed on the platform 10. A buffer solution storage 20, which is connected to the mixing chamber 50 through the channel 40 and provides a predetermined amount of buffer solution to the mixing chamber 50 several times, and a sample storage 20, which provides a sample injected from the outside to the mixing chamber 50, are disposed on a portion of the platform 10, which is closer to the center of the platform 10 than the mixing chamber 50.

The buffer solution storage may have various shapes. However, according to the current embodiment of the present invention, the buffer solution storage may include metering chambers 22 and 23 including exit valves 221 through 223 and 231 through 233 which are independently driven according to water level, wherein the volume of an inner part of each of the exit valves 221 through 223 and 231 through 233 corresponds to a predetermined volume "B1", that is, n times (n is a natural number) the volume of buffer solution to be transferred to the mixing chamber 50 once. The current embodiment of the present invention will be more particularly described with reference to the metering chamber 22 which is disposed in the left of FIG. 1. Each of the exit valves 221 through 223 of the metering chamber 22 is connected to the mixing chamber 50 through each of admission channels 421 through 423 and the channel 40. The exit valves 221 through 223 may be various valves such as capillary valves, hydrophobic valves, mechanical valves or geometric valves as well as phase transition valves which are driven by an eternal energy source. For example, when the exit valves 221 through 223 are capillary valves, a capillary valve having lowest open revolutions may be used as a valve 221 corresponding to have a highest water level, and a capillary valve having highest open revolutions may be used as a valve 223 corresponding to have a lowest water level.

In particular, the sample storage may include a sample chamber 21, and an exit valve 211 of the sample chamber 21, which controls the fluid of flow through a channel 41 connecting the sample chamber 21 with the mixing chamber 50. However, when an initial sample to be serially diluted is directly injected to the mixing chamber 50, the sample storage may not be included.

A plurality of diluted solution chambers 61 through 67 housing diluted sample solutions by concentrations are disposed on a portion of the platform 10, which is farther from the center of the platform 10 than the mixing chamber 50. The mixing chamber 50 is connected to each of the diluted solution chambers 61 through 66 through a channel 43 which is directly connected to a middle exit of the mixing chamber 50, and a plurality of branch channels 431 through 436 which are diverged from the channel 43 and respectively correspond to the diluted solution chambers 61 through 66. However, the diluted solution chamber 67, in which a diluted solution having the lowest concentration is to be housed, may be connected to the mixing chamber 50 through a channel 45 which is directly connected to an exit valve 671 connected to an outermost portion of the mixing chamber 50.

The middle exit of the mixing chamber 50 is connected to a portion of the mixing chamber 50 so that a solution having a predetermined volume "R1" remain in a space between the middle exit and the outermost portion of the mixing chamber 50 when a solution in the mixing chamber 50 is expelled to the outside by a centrifugal force through the middle exit. The channel 43 may be connected to one middle exit or both middle exits of the mixing chamber 50. That is, according to the location of the middle exit through which the channel 43 and the mixing chamber 50 are connected, the volume R1 of the diluted solution which remains in the mixing chamber 50 after being diluted once, is determined.

The channel 43 defines a plurality of flow paths, which are each connected from the mixing chamber 50 to the diluted solution chambers 61 through 66, together with the branch channels 431 through 436. A valve group including a valve or a plurality of valves for independently controlling the flow of fluid may be installed in each of the flow paths. According to the current embodiment of the present invention, a valve group including a normally closed valve 611 and a normally open valve 612 may be installed in each of the flow paths (for example, a flow path including the channel 43 and a first branch channel 431). The normally closed valve 611 and the normally open valve 612 may both be a phase transition valves which can be independently driven by an external energy source.

Figure 2A:
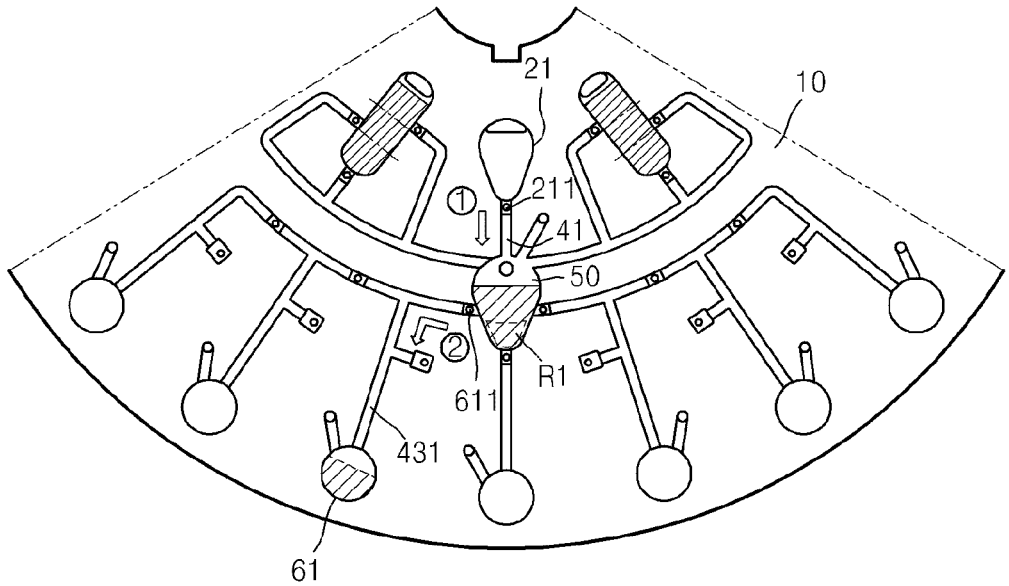
FIGS. 2A through 2C are views illustrating a dilution operation using the microfluidic device of FIG. 1, according to an embodiment of the present invention.
Figure 2B:
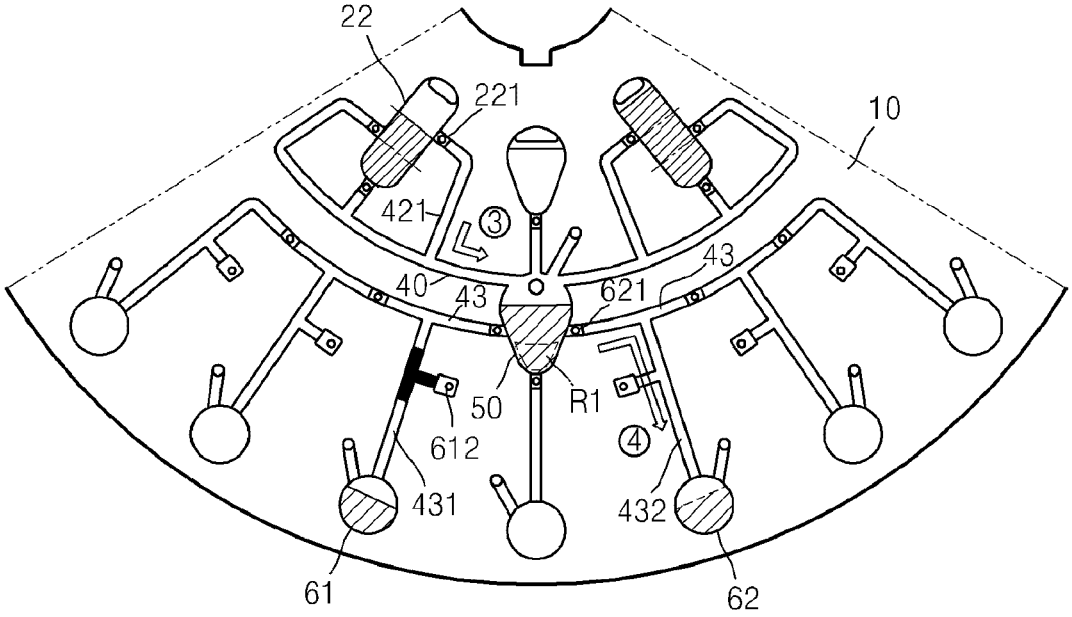
Figure 2C:
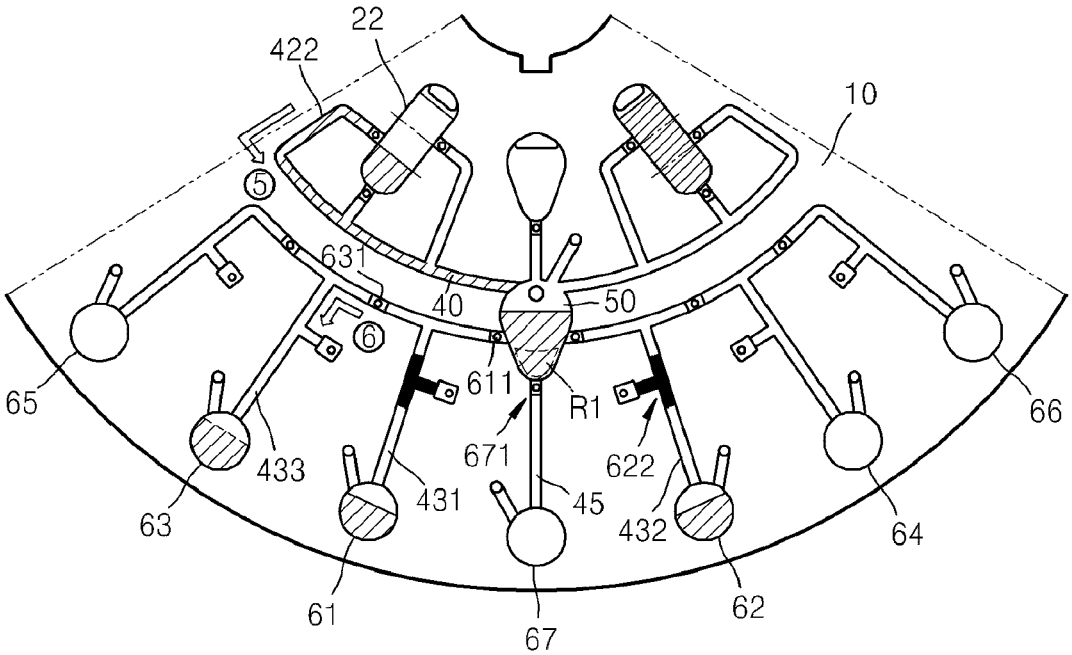

FIGS. 2A through 2C are views illustrating a dilution operation using the microfluidic device of FIG. 1, according to an embodiment of the present invention. As indicated by an arrow, the exit valve 211 of the sample chamber 21 is opened, and then a sample having an initial concentration is transferred to the mixing chamber 50 using a centrifugal force. Then, the normally closed valve 611 of a flow path formed of channels 43 and 431 connected by a first diluted solution chamber 61 is opened, and then a first diluted solution (initial concentration) is transferred using a centrifugal force as indicated by an arrow. After the transfers are finished, the normally open valve 612 of the first branch channel 431 connected to the first diluted solution chamber 61 is closed. At this time, a sample having a predetermined volume "R1" remains in the mixing chamber 50.

Next, referring to FIG. 2B, a first exit valve 221 of the metering chamber 22 is opened, and then a buffer solution having a predetermined volume "B1" is transferred to the mixing chamber 50 and mixed as indicated by an arrow. As a result, a second diluted solution, which is diluted by R1/(R1+B1) times the initial concentration of the sample, is obtained. A normally closed valve 621 of a flow path formed of channels 43 and 432 connected to a second diluted solution chamber 62 is opened, and then the second diluted solution is transferred using a centrifugal force as indicated by an arrow. After the transfers are finished, a normally open valve 622 of the second branch channel 432 connected to the second diluted solution chamber 62 is closed. At this time, the second diluted solution having the predetermined volume "R1" also remains in the mixing chamber 50.

Next, referring to FIG. 2C, a second exit valve 222 of the metering chamber 22 is opened, and then a buffer solution having the predetermined volume "B1" is transferred to the mixing chamber 50 and mixed as indicated by an arrow. As a result, a third solution, which is diluted by $(R1/(R1+B1))^2$ times the initial concentration of the sample, is obtained. A normally closed valve 631 of a flow path formed of channels 43 and 433 connected to a third diluted solution chamber 63 is opened, and then the third diluted solution is transferred using a centrifugal force as indicated by an arrow. After the transfers are finished, a normally open valve 632 of a third branch channel 433 connected to the third diluted solution chamber 63 is closed. At this time, the third diluted solution having the predetermined volume "R1" also remains in the mixing chamber 50.

By repeating the above similar operations, diluted solutions, which are each diluted by R1/(R1+B1) times a diluted solution just before the current operation, can be respectively provided to fourth through sixth diluted solution chambers 64 through 66. A diluted solution, which is lastly diluted in the mixing chamber 50, is transferred to a seventh diluted solution chamber 67 through the exit valve 671 connected to a radial outermost portion of the mixing chamber 50 and the channel 45 connected to the exit valve 671. As described above, factors determining a concentration scale of a serial dilution operation are B1 and R1. Whenever one dilution operation is performed, a solution is diluted by R1/(R1+B1) times. For example, when R1 and B1 are each 40 μl, diluted solutions having concentrations of 1, $2^{-1}$, $2^{-2}$, $2^{-3}$, $2^{-4}$, $2^{-5}$ and $2^{-6}$ times the initial concentration of the sample are respectively put in the first through seventh diluted solution chambers 61 through 67. As another example, when R1 is 10 μl, and B1 is 90 μl, diluted solutions having concentrations of 1, $10^{-1}$, $10^{-2}$, $10^{-3}$, $10^{-4}$, $10^{-5}$ and $10^{-6}$ times the initial concentration of the sample are respectively put in the first through seventh diluted solution chambers 61 through 67.

The diluted solutions having various concentrations can have various uses, for example, in a standard curve or a calibration curve of a real-time PCR for cell counting or quantitative analysis of a gene. In addition, the microfluidic device according to the current embodiment of the present invention can be integrated on a platform together with a centrifugal force based microfluidic device performing other functions, and can easily provide resulting materials using samples of various concentrations.

Figure 3:
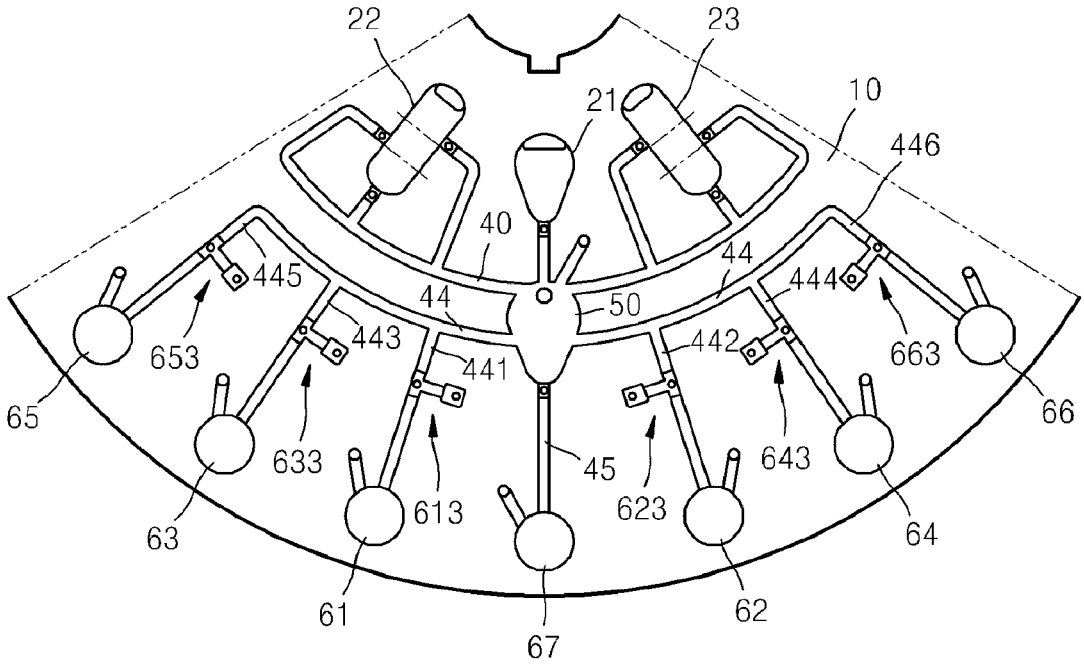
FIG. 3 is a plan view illustrating a centrifugal force based microfluidic device for dilution according to another embodiment of the present invention.

FIG. 3 is a plan view illustrating a centrifugal force based microfluidic device for dilution according to another embodiment of the present invention. Compared with the microfluidic device of FIG. 1, the centrifugal force based microfluidic device of FIG. 3 is different in terms of the type and distribution of valves controlling the flow of fluid in a plurality of flow paths which respectively connect a mixing chamber 50 with a plurality of diluted solution chambers 61 through 66. Referring to FIG. 3, reversible valves 613, 623, 633, 643, 653 and 663 may be respectively installed in a plurality of branch channels 441 through 446 diverged from a channel 44 which is directly connected to each of two middle exits of the mixing chamber 50. Each of the reversible valves 613, 623, 633, 643, 653 and 663 is an example of a phase transition valve. In addition, the reversible valves 613, 623, 633, 643, 653 and 663 can perform operations such as opening and closing flow paths, and can repeat opening and closing operations of flow paths several times if necessary.

Figure 4:
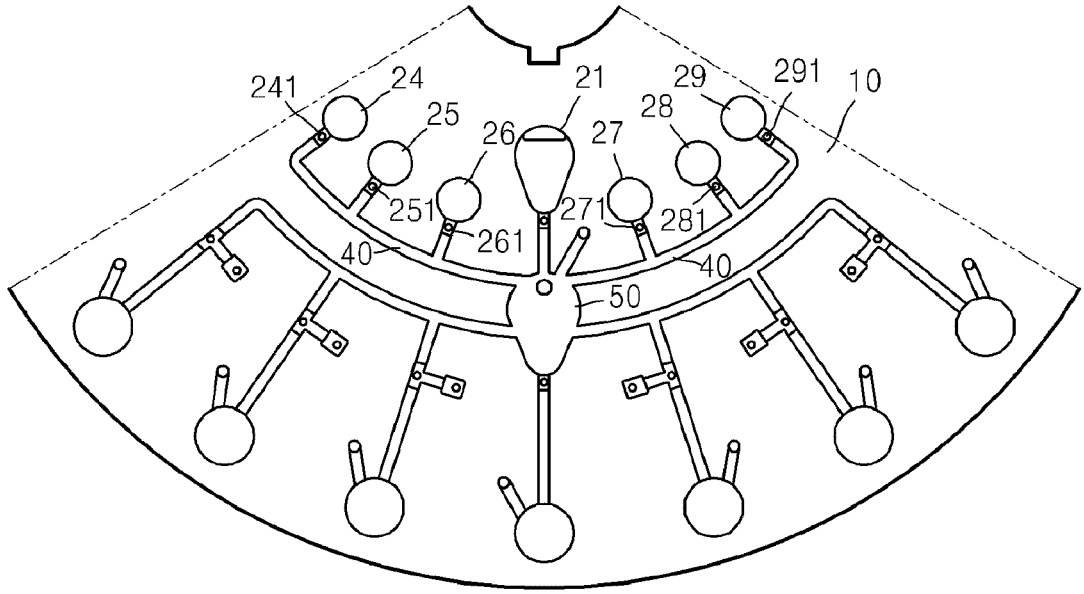
FIG. 4 is a plan view illustrating a centrifugal force based microfluidic device for dilution according to another embodiment of the present invention.

FIG. 4 is a plan view illustrating a centrifugal force based microfluidic device for dilution according to another embodiment of the present invention. Compared with the microfluidic device of FIG. 1, the centrifugal force based microfluidic device of FIG. 4 is different in terms of the shape of a buffer solution storage. Referring to FIG. 4, unlike the device of FIG. 1 including the metering chambers 22 and 23, the centrifugal force based microfluidic device according to the current embodiment of the present invention may include buffer solution chambers 24 through 29 having the number corresponding to the supplying time of buffer solutions, and exit valves 241, 251, 261, 271, 281 and 291 which are independently driven by the buffer solution chambers 24 through 29. The exit valves 241, 251, 261, 271, 281 and 291 may be various valves such as capillary valves and hydrophobic valves, which are opened under revolutions different from each other as well as phase transition valves (normally closed valves), which are independently driven by an external energy source.

Figure 5:
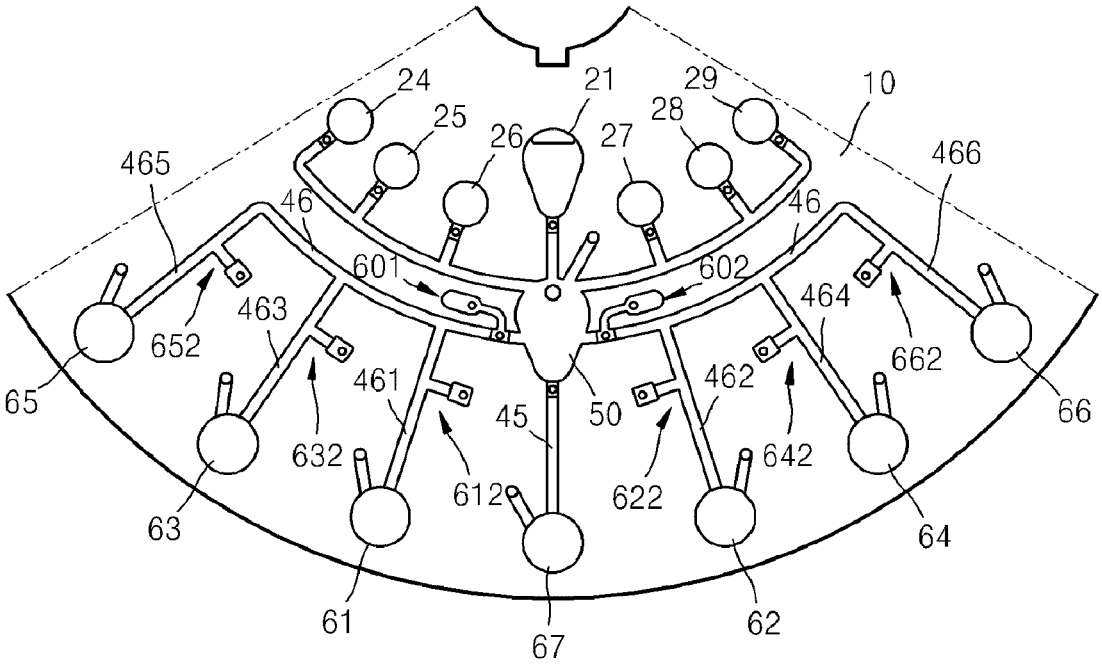
FIG. 5 is a plan view illustrating a centrifugal force based microfluidic device for dilution according to another embodiment of the present invention.

FIG. 5 is a plan view illustrating a centrifugal force based microfluidic device for dilution according to another embodiment of the present invention. Compared with the microfluidic device of FIG. 4, the centrifugal force based microfluidic device of FIG. 5 is different in terms of the type and distribution of valves controlling the flow of fluid in a plurality of flow paths which respectively connect a mixing chamber 50 with a plurality of diluted solution chambers 61 through 66. Referring to FIG. 5, each of reversible valves 601 and 602 is installed in a channel 46 which is directly connected to both middle exits of a mixing chamber 50. Normally open valves 612, 622, 632, 642, 652 and 662, which are independently driven, may be respectively installed in a plurality of branch channels 461 through 466 diverged from the downstream of the channel 46, which is below the reversible valves 601 and 602. The reversible valves 601 and 602 may repeatedly perform opening and closing at least three times. By combination of the reversible valves 601 and 602, which can repeatedly perform opening and closing, and the normally open valves 612, 622, 632, 642, 652 and 662, flow paths connecting the mixing chamber 50 with the diluted solution chamber 61 through 66 can be independently opened and closed.

Figure 6:
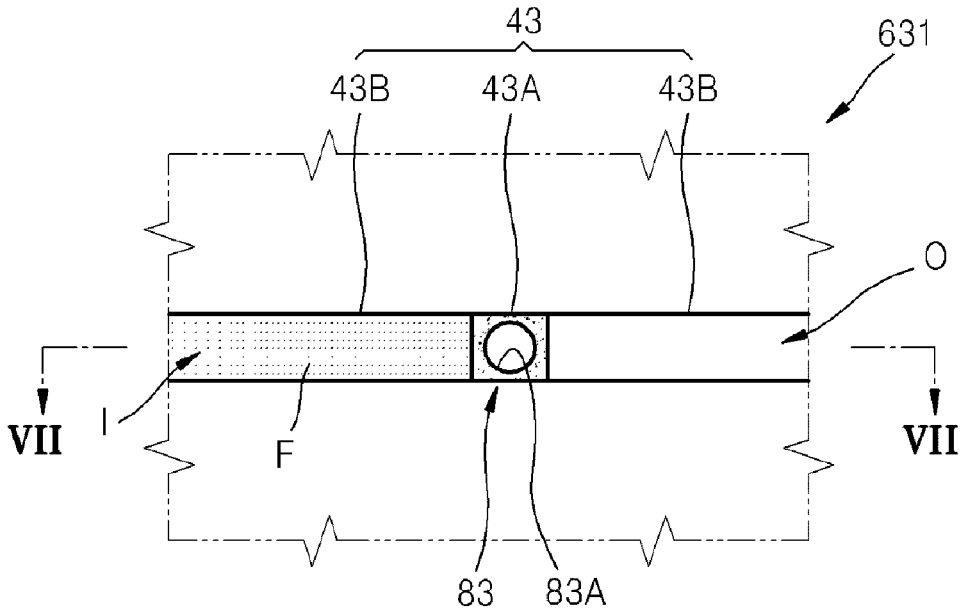
FIG. 6 is a plan view illustrating a normally closed valve used in the microfluidic devices of FIGS. 1 and 3 through 5, according to an embodiment of the present invention.
Figure 7A:
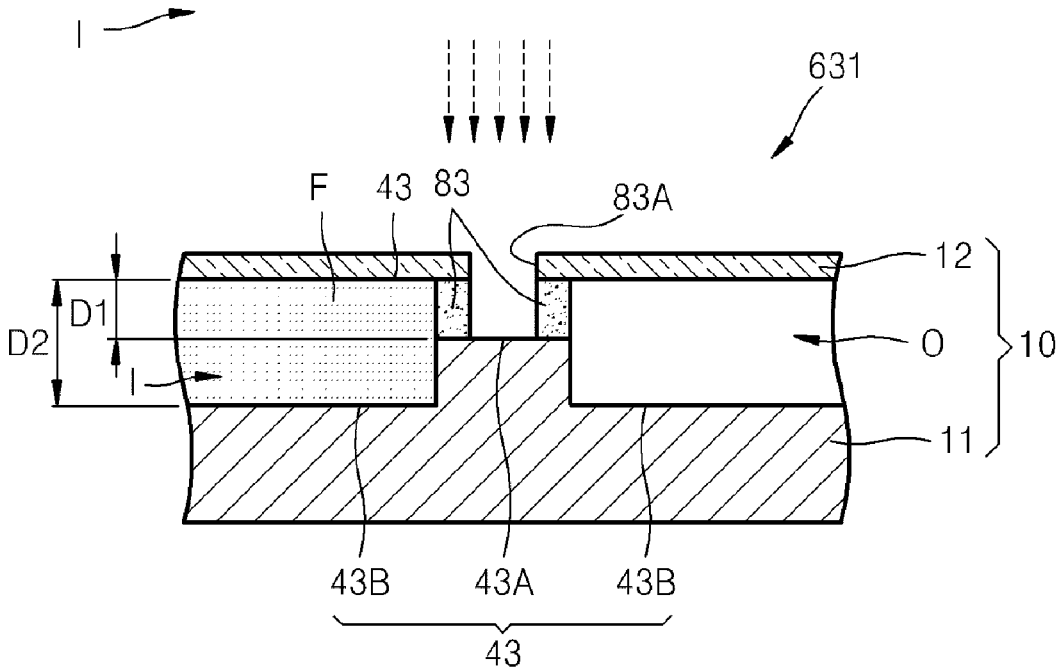
FIGS. 7A and 7B are cross-sectional views for illustrating operations of the normally closed valve of FIG. 6, according to embodiments of the present invention.
Figure 7B:
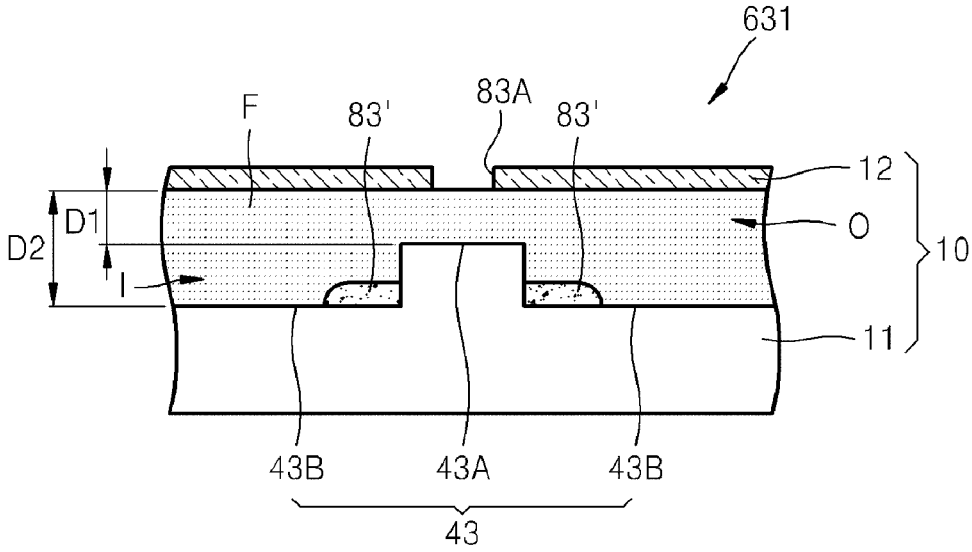

FIG. 6 is a plan view illustrating an normally closed valve 631 used in the microfluidic devices of FIGS. 1 and 3 through 5, according to an embodiment of the present invention. FIGS. 7A and 7B are cross-sectional views for illustrating operations of the normally closed valve 631 of FIG. 6, according to an embodiment of the present invention. The normally closed valve 631 includes a valve plug 83 formed of a valve material which is solid state at a room temperature. The valve material may be a material in which heating particles are dispersed in a dispersion medium formed of a phase transition material. The channel 43 comprises a first area 43A of a first dimension D1 and a pair of second areas 43B adjacent to the first area 43A. The second areas 43B are of a second dimension D2 larger than D1.

The valve plug 83 completely blocks without a gap a predetermined portion of the first area 43A which is not overlapped with an opening 83A and blocks the flow of fluid F flowing from an entrance "I", The valve plug 83 is melted at a high temperature and is moved from the first area 43A to the second areas 43B, and then the valve plug 83 is again solidified while flow paths of the fluid F is opened (See 83'). The opening 83A functions as an injection hole which can define a valve plug by injecting a valve material melted when manufacturing the microfluidic device. The valve material injected into the first area 43A through the opening 83A remains in the predetermined portion of the first area 43A by capillary action.

An external energy source (see 130L of FIG. 13) is disposed outside the microfluidic device 100 (see 100 of FIG. 13) in order to supplying heat to the valve plug 83. The external energy source 130L emits electromagnetic waves to a region including an initial location of the valve plug 83, that is, the opening 83A and the circumstance thereof. At this time, the external energy source 130L may be, for example, a laser light source emitting a laser beam, wherein the laser light source may include at least one laser diode. When the laser light source emits a pulse laser beam, the laser light source can emit a pulse laser beam having energy of 1 mJ/pulse or more. When the laser light source emits a continuous wave laser beam, the laser light source can emit a continuous wave laser beam having power of 10 mW or more. Any laser light source emitting a laser beam having a wavelength in the range of 400 through 1300 nm can be used as the external energy source 130L of the microfluidic system.

Referring to FIGS. 7A and 7B, the channel 43 can be provided by stereoscopic patterns formed inside an upper substrate 12 or a lower substrate 11 constituting a disk type platform 10. The upper substrate 12 may be formed of an optically transparent material which can transmit electromagnetic waves emitted by an external energy source so that the electromagnetic waves may be incident on the valve plug 83, and by which the flow of fluid F can be seen from the outside. For example, the upper substrate 12 may be preferably formed of a glass material or a transparent plastic material which has excellent optical transparency and reduced manufacturing costs.

Heating particles dispersed on the valve plug 83 may each have a diameter in the range of 1 nm to 100 μm so as to freely flow in the channel 43 having a width of several thousands of micrometers (μm). The heating particles have properties by which the temperature of the heating particles is remarkably increased when a laser is irradiated to the heating particles, and as such the heating particles emit heat. In addition, the heating particles have properties by which the heating particles are regularly dispersed in wax. The heating particles may have a structure including a core having a metal component and a shell which is water-repellant so as to have the above properties. For example, the heating particles may have a structure including a core formed of Fe, which is a ferromagnetic material, and a shell formed of a plurality of surfactants coupled to the core and surrounding the core. Generally, the heating particles are stored to be dispersed in carrier oil. The carrier oil may be water-repellant so that the heating particles having a water-repellant surface structure may be regularly dispersed. By filling wax with the carrier oil in which the heating particles are dispersed and mixing the resulting materials, a material used for forming the valve plug 83 may be manufactured. The particle shape of each of the heating particles is not limited to the above examples. That is, each of the heating particles may be a polymer bead, quantum dots, Au nanoparticles, Ag nanoparticles, beads with metal composition, carbon particles or magnetic beads. The carbon particles may include graphite particles.

A phase transition material constituting the valve plug 83 may be wax. Energy of electromagnetic waves, which is absorbed by the heating particles, is transferred to the circumstance in type of thermal energy, and as such the wax is melted to have fluidity. Accordingly, the valve plug 83 is collapsed and the fluid path of fluid F is opened. The wax constituting the valve plug 83 may have an appropriate melting point. If the melting point of the wax is very high, since a long time is required from when a laser beam is not emitted to the wax until the wax is melted, it is difficult to minutely control an opening time. On the other hand, if the melting point of the wax is very low, since the wax may be partially melted while a laser beam is not emitted, the fluid F may be leaked. The wax may be, for example, paraffin wax, microcrystalline wax, synthetic wax, natural wax or the like.

Figure 8:
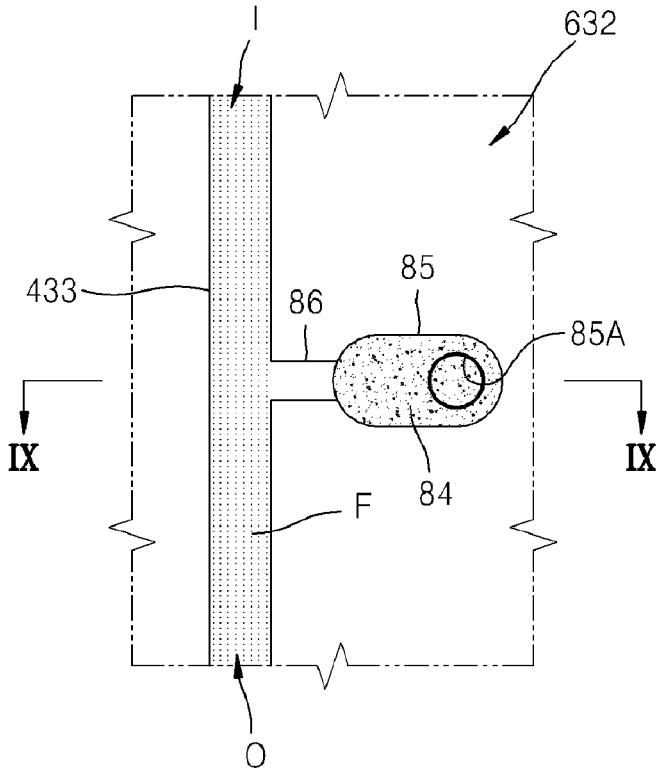
FIG. 8 is a plan view illustrating a normally open valve used in the microfluidic devices of FIGS. 1 and 3 through 5, according to an embodiment of the present invention.
Figure 9:
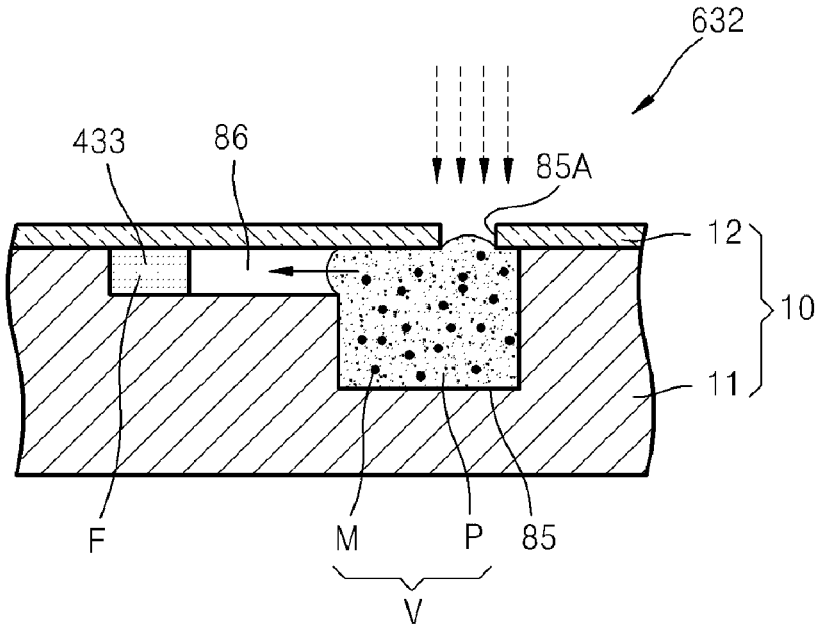
FIG. 9 is a cross-sectional view for illustrating operations of the valve of FIG. 8, according to an embodiment of the present invention.

Meanwhile, the phase transition material may be gel or a thermoplastic resin. The gel may be polyacrylamide, polyacrylates, polymethacrylates, polyvinylamides or the like. In addition, the thermoplastic resin may be cyclic olefin copolymer (COC), polymethylmethacrylate (acrylic) (PMMA), polycarbonate (PC), polystyrene (PS), polyacetal engineering polymers (POM), perfluoroalkoxy (PFA), polyvinyl chloride (PVC), polypropylene (PP), polyethylene terephthalate (PET), polyetheretherketone (PEEK), polyamide (PA), polysulfone (PSU), polyvinylidene difluoride (PVDF), or the like. FIG. 8 is a plan view illustrating the normally open valve 632 used in the microfluidic devices of FIGS. 1 and 3 through 5, according to an embodiment of the present invention. FIG. 9 is a cross-sectional view for illustrating operations of the normally open valve 632 of FIG. 8, according to an embodiment of the present invention.

The normally open valve 632 includes a valve material container 85 and a valve material V. The valve material container 85 is connected between channels 433 having an inlet "I" and an outlet "O", The valve material V is filled in the valve material container 85 to be solid at an initial stage, that is, at room temperature, melted and expanded to flow into the channels 433 through a valve connecting path, and again solidified to block the channels 433.

Referring to FIG. 9, the normally open valve 632 may be provided a stereoscopic pattern formed inside an upper substrate 12 and a lower substrate 11 constituting a platform 10 of the microfluidic device 100 similarly to the normally closed valve 631 as described above. The upper substrate 12 may be formed of an optically transparent material which can transmit an electromagnetic waves emitted by an external energy source and by which the flow of fluid F can be seen from the outside. In addition, the upper substrate may include an opening 85A corresponding to the valve material container 85 so that the electromagnetic waves (for example, a laser beam) may be incident on the valve material V. The opening 85A may function as an injection hole to which a valve material melted is injected during manufacturing the microfluidic device.

A phase transition material P constituting the valve material V and heating particles M are the same as those described with reference to the normally closed valve 631. In addition, the external energy source supplying electromagnetic waves to the valve material V is the same as that described above.

When a laser beam is emitted to the valve material V solidified in the valve material container 85, the heating particles M absorb energy to heat the phase transition material P.

Accordingly, while the valve material V is melted, the volume of the valve material V is expanded, and the valve material V flows into the channels 433 through the valve connecting path 86. The valve material V, which is again solidified while contacting fluid F in the channels 433, blocks the flow of fluid F passing through the channel 433.

The results of the experiment, in which response times of the normally closed valve and the normally open valve are measured, will be described. The pressure of operating fluid in a test chip for the experiment was maintained as 46 kPa. In order to maintain the pressure, a syringe pump (Havard PHD2000, USA) and a pressure sensor (MPX 5500DP, Freescale semiconductor Inc., AZ, USA) were used. A laser light source, of which emitting wave has a wavelength of 808 nm and which has power of 1.5 W, was used as an external energy source emitting electromagnetic waves to the valves. Data of the response time of the valves was obtained by analyzing the result of a high-speed photography device (Fastcam-1024, Photron, Calif., USA). The valve plug may be magnetic wax in which magnetic beads, which are heating particles having an average diameter of 10 nm, are dispersed in carrier oil, and in other words, ferrofluid and paraffin wax were mixed by a ratio of 1 to 1, that is, the volume fraction of the ferrofluid is 50%. The response time, from when a laser beam is emitted to a valve plug of the normally closed valve until the valve plug is solidified to open a channel, is 0.012 seconds. The response time, from when a laser beams is emitted to a valve material container of the valve material until the valve material is melted and expanded to close a channel, is 0.444 seconds. It can be seen that the valves according to the embodiments of the present invention can be more quickly operated than a conventional wax valve in that the response time of the conventional wax valve is 2 through 10 seconds.

Figure 10:
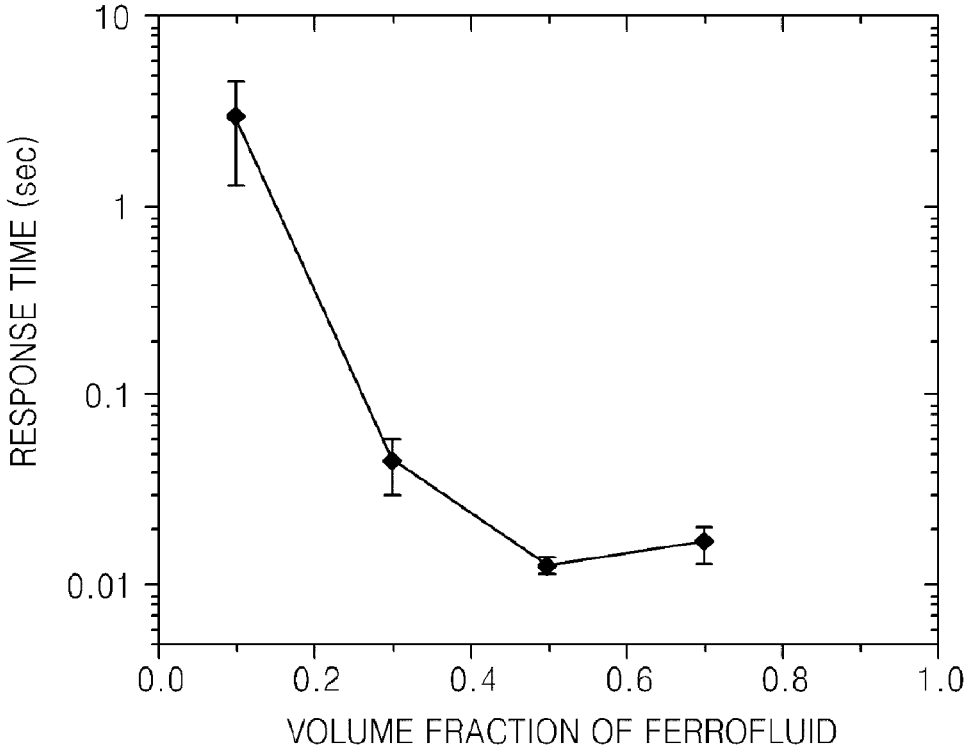
FIG. 10 is a graph illustrating the relationship between the volume fraction of the ferrofluid included in a valve plug of the normally closed valve of FIG. 6 and the response time of the normally closed valve, according to an embodiment of the present invention.

FIG. 10 is a graph illustrating the relationship between the volume fraction of the ferrofluid included in the valve plug and the response time of the normally closed valve with respect to the normally closed valve of FIG. 6. As the volume fraction of the ferrofluid is increased, the response time is roughly reduced. However, irrespective of this, when the volume fraction of the ferrofluid is increased to be 70% or more, the maximum hold-up pressure of the valve plug has a tendency to be reduced. Accordingly, the volume fraction of the ferrofluid to be included in the valve plug of the valve unit may be determined according to regulation between the requirement for the response time and the requirement for the maximum hold-up pressure.

Figure 11:
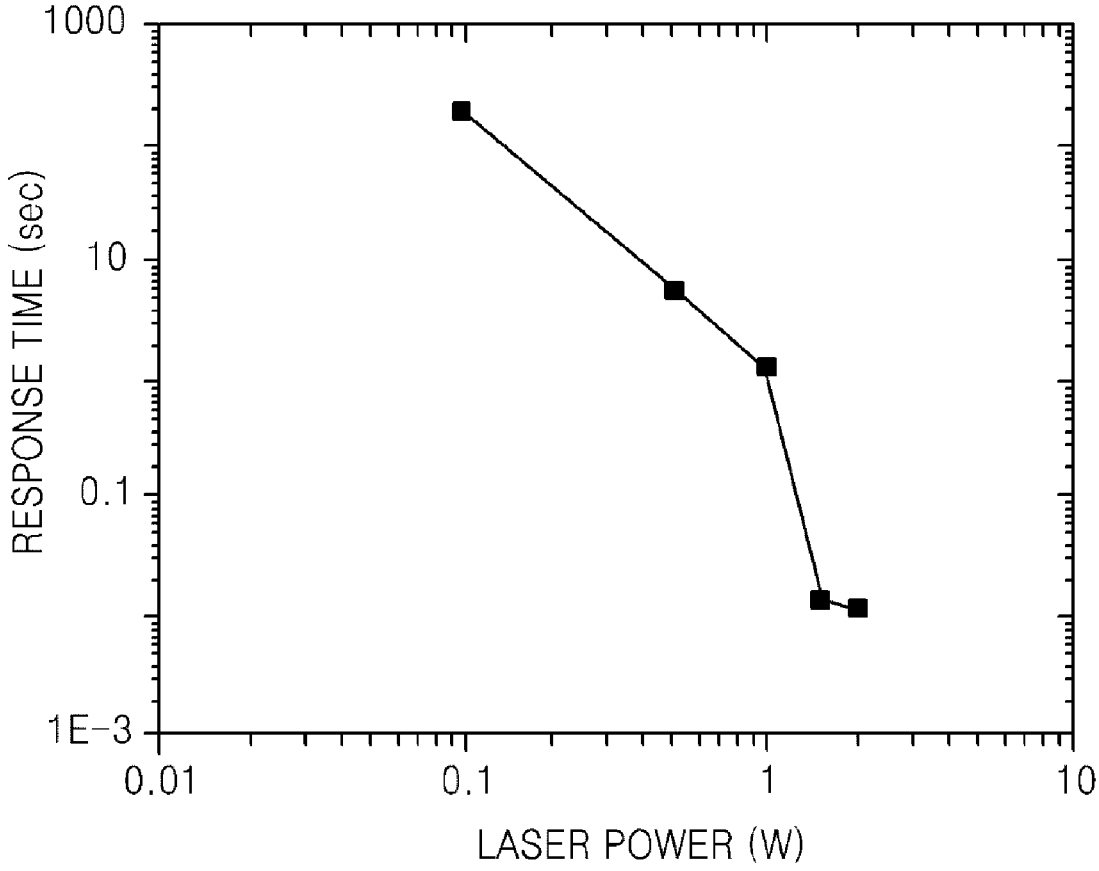
FIG. 11 is a graph illustrating the relationship between power of a laser light source used as an external energy source and the response time of the normally closed valve of FIG. 6, according to an embodiment of the present invention.

FIG. 11 is a graph illustrating the relationship between power of a laser light source used as an external energy source and the response time of the normally closed valve with respect to the normally closed valve of FIG. 6. As the power is increased, the response time is roughly reduced. However, when the power of the laser light source is close to 1.5 W, the response time is slowly changed. Although not illustrated, when the power of the laser light source is greater than 1.5 W, the response time is converged to a predetermined minimum response time. This is because there is a limit to the thermal conductivity of paraffin wax. A laser light source having power of 1.5 W is used because of this reason, but the present invention is not limited thereto.

FIGS. 12A through 12F are perspective views for illustrating operations of reversible valves 601 used in the microfluidic devices of FIGS. 3 and 5, according to an embodiment of the present invention.

Referring to FIGS. 12A through 12F, the reversible valve 601 used in the microfluidic devices of FIGS. 3 and 5 is an example of a phase transition valve which is independently driven by en external energy source. The reversible valve 601 includes a valve material container 95, a valve material V injected to the valve material container 95, a valve connecting path 96 connecting the valve material container 95 with a channel 46 defining the flow path of fluid F, and a laser light source 130 which is an example of an energy source for supplying energy to the valve material V. The laser light source 130 emits a laser beam L which is a kind of an electromagnetic wave, but the present invention is not limited to a laser light source. That is, the energy source may emit infrared rays IR, or inject a high temperature gas to supply energy to the valve material V.

The valve material container 95, the channel 46, and the valve connecting path 96 may be formed on a disk type platform 10 including an upper substrate 12 and a lower substrate 11 which are bonded to each other. The upper substrate 12 and the lower substrate 11 may be bonded using adhesive, double-sided adhesive tape or ultrasonic fusion. In particular, the valve material container 95, the channel 46, and the valve connecting path 96 may be engraved to be patterned on the lower substrate 11. An opening 95A for injecting the valve material V to the valve material container 95 is formed in the upper substrate 12. The channel 46 comprises a first area 46A of a first dimension D1 and a pair of second areas 46B adjacent to the first area 46A. The second areas 46B are of a second dimension D2 larger than D1.

Figure 12A:
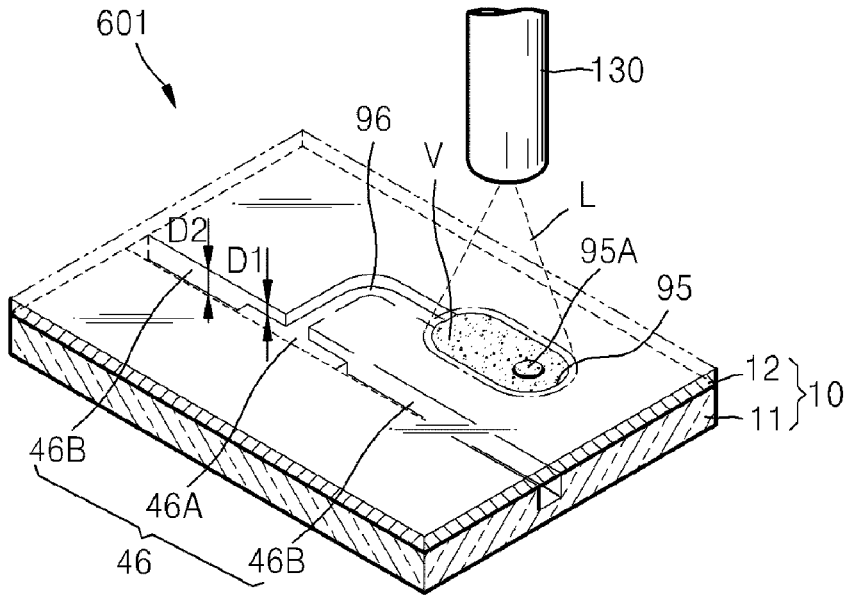
FIGS. 12A through 12F are perspective views illustrating operations of reversible valves used in the microfluidic devices of FIGS. 3 and 5, according to an embodiment of the present invention.
Figure 12B:
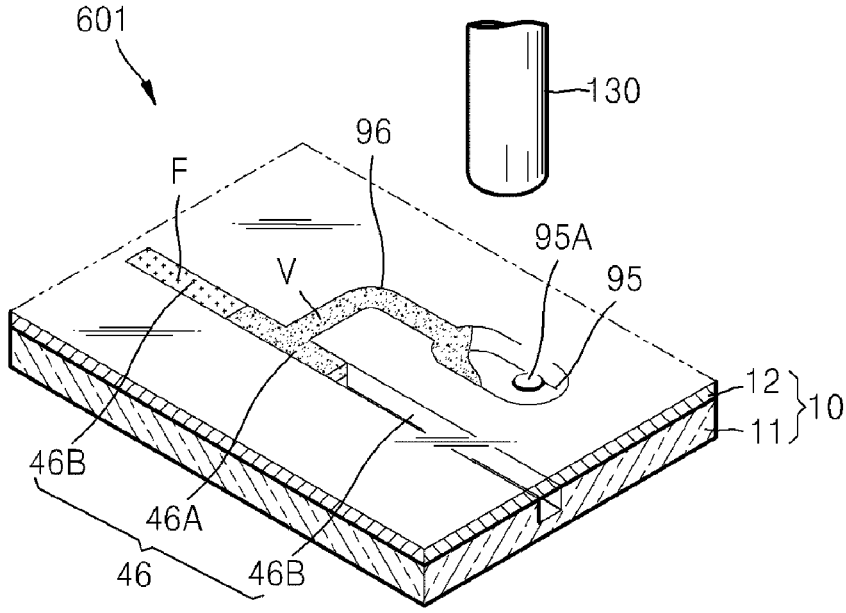

As illustrated in FIG. 12A, when the laser beam L is emitted to the valve material V, which is injected to the valve material container 95 for a while to be hardened, by the laser light source 130, the valve material V is explosively melted to be expanded, and flows into the first area 46A of the channel 46 through the valve connecting path 96. As illustrated in FIG. 12B, the valve material V flowing into the channel 46 proceeds by capillary action and the valve material remains in the first area 46A to be hardened, and thus a valve plug blocking the channel 46 is formed. Accordingly, the fluid F cannot flow along the channel 46 any more.

Figure 12C:
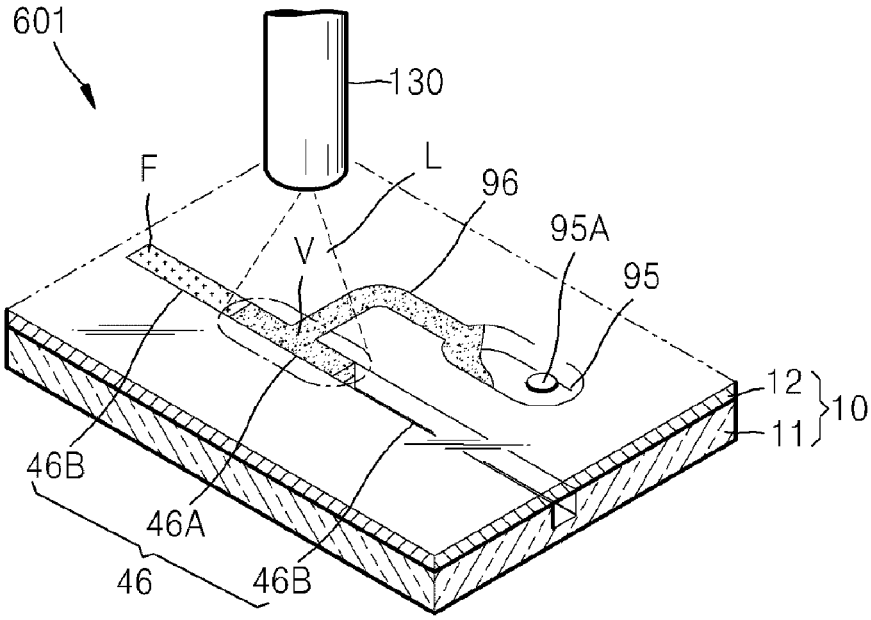
Figure 12D:
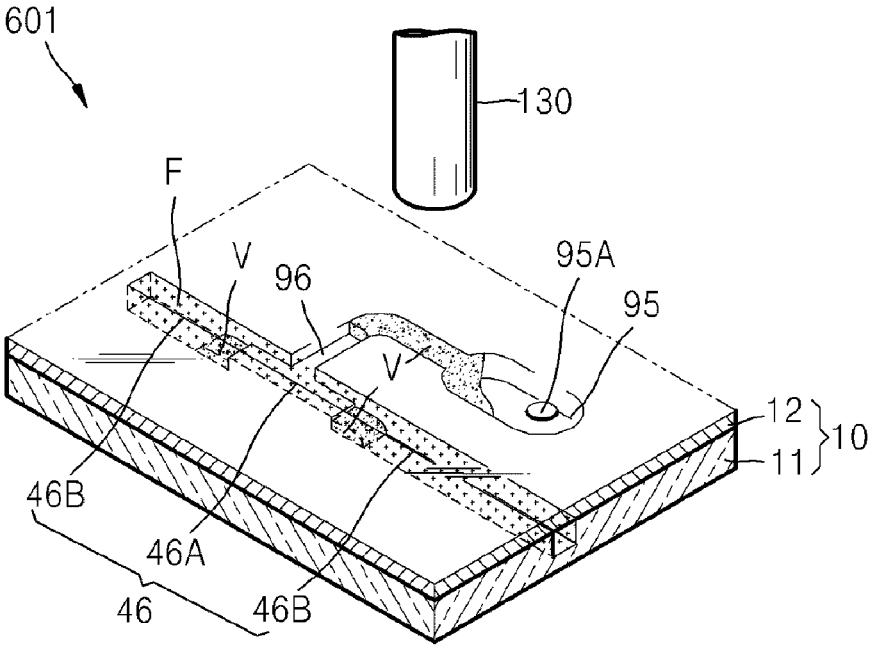

As illustrated in FIG. 12C, when the laser beam L is emitted to the valve material V hardened in the first area 46A, the hardened valve material V is explosively melted to be expanded. The valve material V flows into the second areas 46B of the channel 46, and thus the channel 46 is again opened, as illustrated in FIG. 12D. Accordingly, the fluid F can flow along the channel 46 again.

Figure 12E:
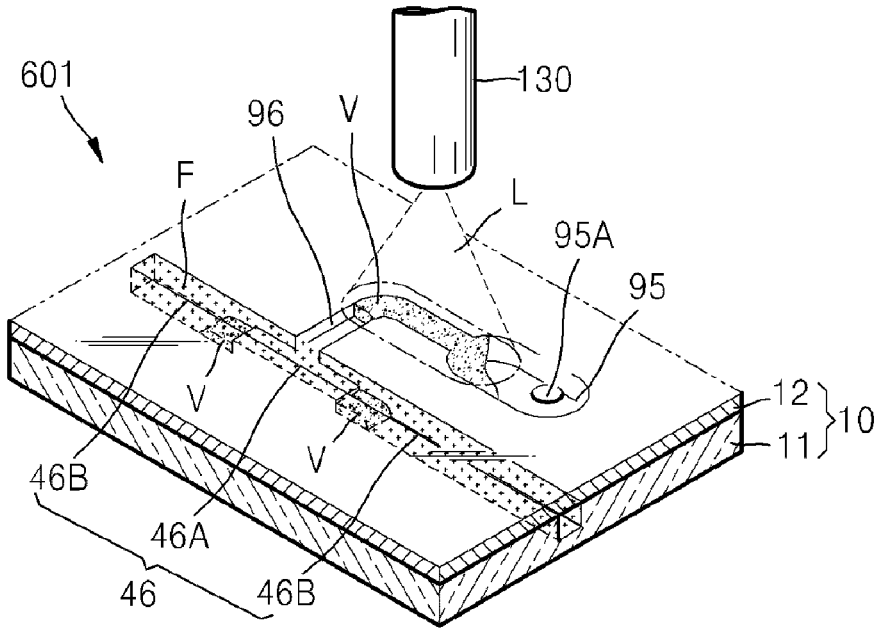
Figure 12F:
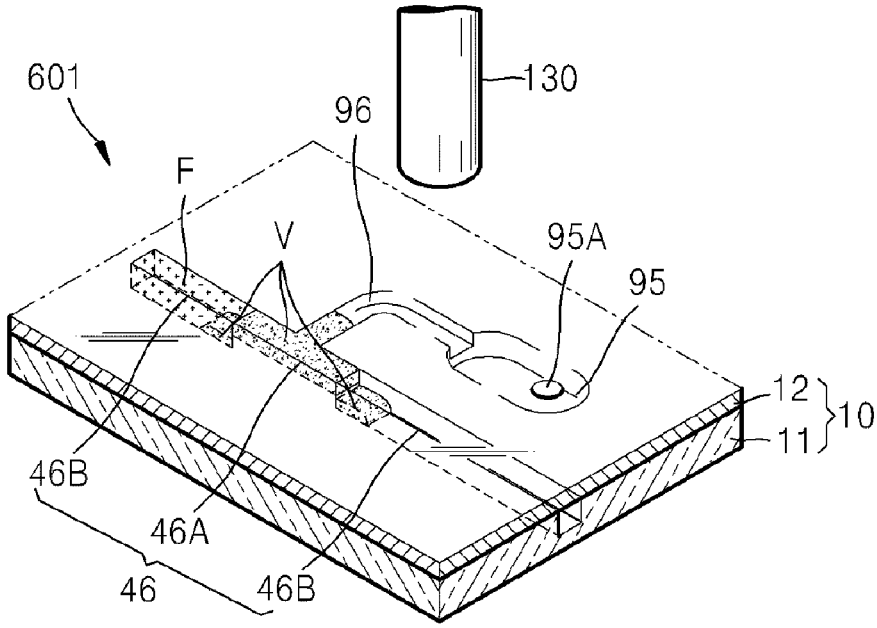

As illustrated in FIG. 12E, when the laser beam L is emitted to the valve material V remaining in the valve material container 95 and the valve connecting path 96 by the laser light source 130, the hardened valve material V is again explosively melted to be expanded. The valve material V flows into the first area 46A. As illustrated in FIG. 12F, the valve material V remains in the first area 46A to be hardened in the first area 46A, thus again closing the channel 46. Like this, the laser beam L is repeatedly emitted until the valve material V is mostly in the second areas 46B of the channel 46, and thus the channel 46 can be repeatedly opened and closed.

Figure 13:
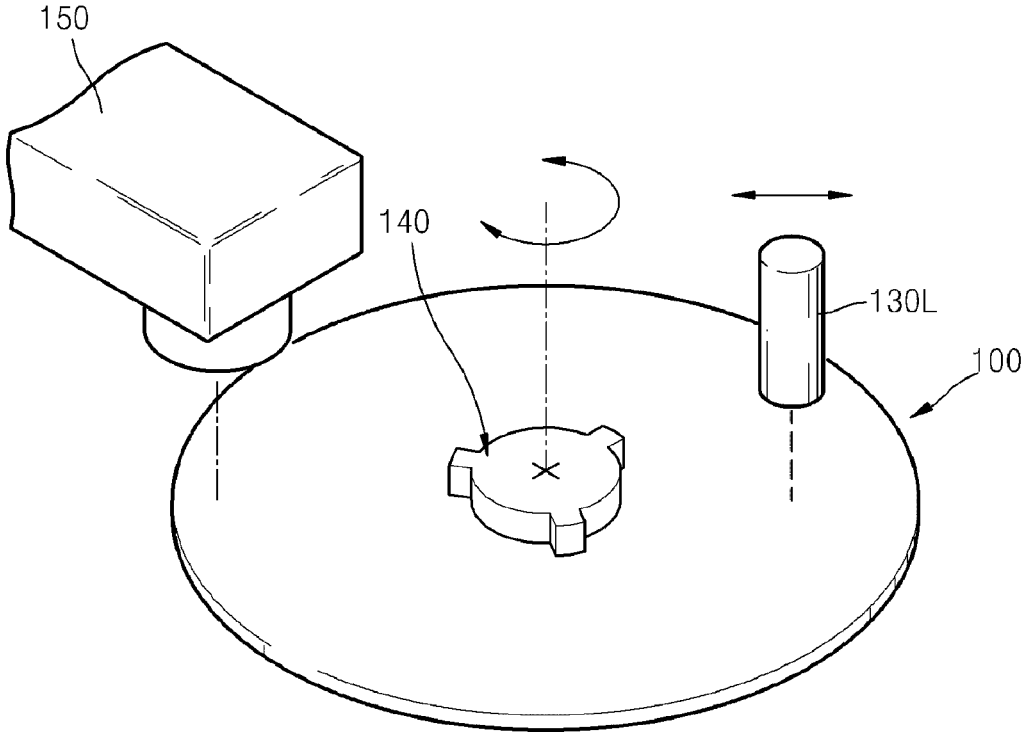
FIG. 13 is a perspective view illustrating a microfluidic system including one of the microfluidic devices of FIGS. 1 and 3 through 5, according to an embodiment of the present invention.

FIG. 13 is a perspective view illustrating a microfluidic system including one of the microfluidic devices of FIGS. 1 and 3 through 5, according to an embodiment of the present invention. Referring to FIG. 13, the microfluidic system according to the current embodiment of the present invention includes the microfluidic device 100 described above. The microfluidic system includes an external energy source 130L emitting predetermined electromagnetic waves to supply energy to valves using a phase transition material which are independently driven as described above. The external energy source 130L may be a device which can emit electromagnetic waves having a predetermined wavelength band, such as microwaves, infrared rays, visible rays, ultraviolet rays or X-rays, preferably, a device which can intensively emit the electromagnetic waves to a short-distance target. The wavelength of waves generated by the external energy source 130L may be in the range such that the waves may be not well absorbed by the heating particles M included in the valve material V. Accordingly, a device generating electromagnetic waves from the external energy source 130L may be appropriately selected according to the materials and surface conditions of the heating particles M. The external energy source 130L may be, for example, a laser light source emitting a laser beam. At this time, the laser light source may include at least one laser diode. Details such as the wavelength and the power of the laser beam may be determined according to the kinds of the heating particles included in the phase transition valve of the microfluidic device 100 which is mainly used objective.

The microfluidic system according to the current embodiment of the present invention includes an external energy source controller (not shown) such that electromagnetic waves emitted from the external energy source 130L may be intensively incident on a desired region of the microfluidic device 100, more particularly, a region corresponding to any one of a plurality of phase transition valves included in the microfluidic device 100 by controlling the location and the direction of the external energy source 130L. In the microfluidic system according to the current embodiment of the present invention, the external energy source controller can move the external energy source 130L facing the platform 10 of the microfluidic device 100 in an arrow direction indicated over the microfluidic device 100, that is, a radial direction of the platform 10. The external energy source 130L may be moved in a straight direction using different mechanisms. Those mechanisms are obvious to those of ordinary skill in the art, and thus descriptions thereof will not be included.

Meanwhile, the microfluidic system according to the current embodiment of the present invention includes a revolution driving unit 140 driving the platform 10. The revolution driving unit 140 stabilizes the platform 10, and is an element for transmitting rotary power. Although not illustrated, the revolution driving unit 140 may include a motor and a related component thereof, which can revolve the platform 10 by a desired velocity or angular rotation. Similarly to the external energy source controller, a specific example of a structure of the revolution driving unit 140 will not be included. In the microfluidic system according to the current embodiment of the present invention, the external energy source 130L can intensively emit electromagnetic waves to a selected region of the microfluidic device 100 by help of the external energy source controller and the revolution driving unit 140.

Meanwhile, the microfluidic system according to the current embodiment of the present invention may further include a light detector 150 by which results of various experiments using the concentration of a diluted solution and diluted solutions, which are results of serial dilution using the microfluidic device 100, can be optically observed. For example, by observing each of the diluted solution chambers 61 through 67 using the light detector 150 during the serial dilution of a dyed cell solution, the concentration of the diluted cell solution can be inspected.

Figure 14:
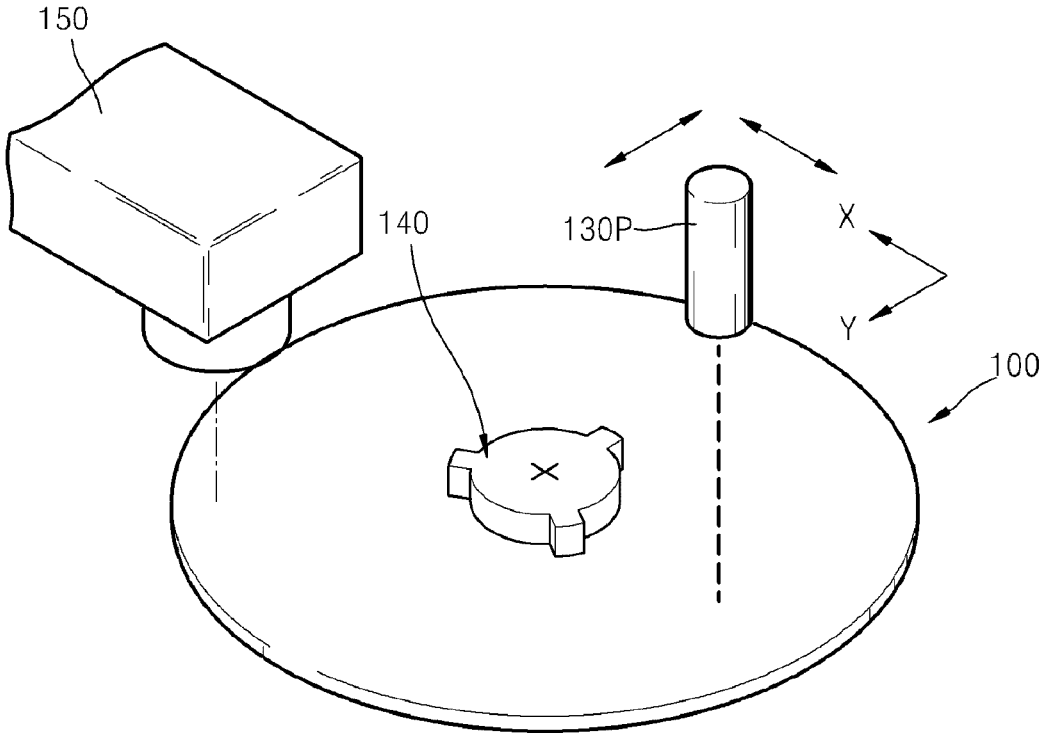
FIG. 14 is a perspective view illustrating a microfluidic system including one of the microfluidic devices of FIGS. 1 and 3 through 5, according to another embodiment of the present invention.

FIG. 14 is a perspective view illustrating a microfluidic system including any one of the microfluidic devices 100 of FIGS. 1 or 3 through 5, according to another embodiment of the present invention. In the microfluidic system according to the current embodiment of the present invention, descriptions of the microfluidic device 100, a revolution driving unit 140 and an external energy source 130P are the same as those of FIG. 13 described above and thus detailed descriptions thereof will not be repeated. However, in the microfluidic system according to the current embodiment of the present invention, an external energy source controller (not shown) may include a plane moving unit such that the external energy source 130P facing the platform 10 may be moved in two directions perpendicular to each other (for example, directions of x and y axes, refer to arrows) on a plane parallel to the platform 10, and electromagnetic waves may be emitted to an objective target on the platform 10.

Although not illustrated, the external energy source controller may be configured such that the emitted electromagnetic waves may reach an objective target by changing the direction of the eternal energy source of which location is fixed at a predetermined point over the platform 10.

According to the present invention, the microfluidic device for dilution and the microfluidic system including the microfluidic device can automatically provide samples having various concentrations without additional manual processes except for a manual step in which a sample is initially injected. Since the serial dilution used in the present invention can provide higher precision than conventional serial dilution using manual processes, concentration error can be reduced. In addition, when the microfluidic device for serial dilution and the microfluidic system including the microfluidic device are used in an automated lab-on-a disk for quantitative analysis of genes, a calibrator sample can be automatically provided.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A centrifugal force based microfluidic device for dilution, comprising:

a rotatable disk type platform;

a mixing chamber disposed on the platform;

a buffer solution storage disposed on a portion of the platform which is closer to a center of the platform than the mixing chamber, connected to the mixing chamber through a channel to supply a predetermined amount of buffer solution to the mixing chamber at least one time; and a plurality of diluted solution chambers which are disposed on a portion of the platform which is farther from the center of the platform than the mixing chamber, are each connected to the mixing chamber through flow paths extended from a middle exit corresponding to a predetermined water level, and sequentially receiving a solution which is serially diluted in the mixing chamber at least one time, wherein the middle exit is formed in a side portion of the mixing chamber, and a second exit is formed in the mixing chamber at a position closer to an outer circumference of the platform than the middle exit.

2. The microfluidic device of claim 1, further comprising:

a sample storage disposed on a portion of the platform which is closer to the center of the platform than the mixing chamber, and which supplies a sample injected from the outside to the mixing chamber using a centrifugal force.

3. The microfluidic device of claim 1, wherein the buffer storage comprises a metering chamber having a number of exit valves each of which is located corresponding to each of the number of water levels and is independently driven, and each of the water levels corresponds to n times a predetermined buffer volume, where n is a natural number.

4. The microfluidic device of claim 1, wherein the mixing chamber comprises a first exit valve which is connected to a first exit opening which corresponds to the middle exit of the mixing chamber and a second exit value connected to the second exit opening of the mixing chamber.

5. The microfluidic device of claim 1, wherein the middle exit is formed in a middle of the side portion of the mixing chamber, and the second exit opening is provided at an outermost portion of the mixing chamber.

6. The microfluidic device of claim 5, wherein the middle exit is formed in the middle of the side portion of the mixing chamber such that a solution having predetermined volume remains in a space between the middle exit and the second exit when the solution is expelled through the middle exit to the outside by a centrifugal force.

7. The microfluidic device of claim 1, wherein the buffer solution storage comprises a plurality of buffer chambers comprising exit valves each of which are independently driven, and each having the same volume.

8. The microfluidic device of claim 7, wherein the exit valves are capillary valves configured to open at different revolving speeds of the rotatable disk type platform.

9. The microfluidic device of claim 1, wherein a valve or a valve group, which independently opens and closes the diluted solution chambers, is installed in each of the flow paths connected from the middle exit of the mixing chamber to the diluted solution chambers.

10. The microfluidic device of claim 9, wherein the valve or the valve group comprises a valve material in which a heating particle dispersed in a phase transition material dispersion medium which is solid at a room temperature, and a transition valve operated using an operation in which the valve material is melted by heat generated by electromagnetic waves emitted from an external energy source and moved, and the channel is opened and closed.

11. The microfluidic device of claim 10, wherein the valve group comprises a pair of phase transition valves comprising a normally closed valve and a normally open valve.

12. The microfluidic device of claim 10, wherein the phase transition material dispersion medium is at least one selected from the group consisting of wax, gel and a thermoplastic resin.

13. The microfluidic device of claim 10, wherein the diameter of the heating particle is in the range of nm 1 to 100 μm.

14. The microfluidic device of claim 10, wherein the heating particle is formed of at least one selected from the group consisting of a polymer bead, a quantum dot, an Au nanoparticle, an Ag nanoparticle, a bead with metal composition, a carbon particle and a magnetic bead.

15. The microfluidic device of claim 10, wherein the transition valve is configured to open and close a particular flow path in immediate proximity to the transition valve several times.

16. A centrifugal force based microfluidic system, comprising:

a microfluidic device for dilution comprising a rotatable disk type platform, a mixing chamber disposed on the platform, a buffer solution storage disposed on a portion of the platform which is closer to a center of the platform than the mixing chamber, connected to the mixing chamber through a channel to supply a predetermined amount of buffer solution to the mixing chamber at least one time, and a plurality of diluted solution chambers which are disposed on a portion of the platform which is farther from the center of the platform than the mixing chamber, are each connected to the mixing chamber through flow paths extended from a middle exit corresponding to a predetermined water level, and sequentially receives a solution which is diluted in the mixing chamber at least one time;

a revolution driving unit revolve so as to support and control the microfluidic device; and a valve driving unit which independently drives a valve selected in the microfluidic device wherein the middle exit is formed in a side portion of the mixing chamber, and a second exit is formed in the mixing chamber at a position closer to an outer circumference of the platform than the middle exit.

17. The microfluidic system of claim 16, wherein the valve driving unit comprises:

an external energy source emitting an electromagnetic wave having a wavelength band such that heating particles in the valve are heated; and an external energy source controller controlling a location and a direction of the external energy source such that an electromagnetic wave emitted by the external energy source is intensively incident on a region corresponding to the selected valve.

18. The microfluidic system of claim 17, wherein the external energy source controller comprises a straight moving unit moving the external energy source facing the platform of the microfluidic device in a radial direction of the platform.

19. The microfluidic system of claim 17, wherein the external energy source supplier comprises a plane moving unit moving the external energy source facing the platform of the microfluidic device in two directions on a plane parallel to the platform with respect to rectangular coordinates.

20. The microfluidic system of claim 16, further comprising:

a sample storage disposed on the platform, such that the sample storage is disposed closer to the center of the platform than the mixing chamber, and supplying a sample injected from the outside by a centrifugal force.

21. The microfluidic system of claim 16, wherein the buffer storage comprises a metering chamber having a number of exit valves each of which is located corresponding to each of the number of water levels and is independently driven, and each of the water levels corresponds to n times a predetermined buffer volume, where n is a natural number.

22. The microfluidic system of claim 16, wherein the buffer solution storage comprises a plurality of buffer solution chambers comprising exit valves, which are independently driven and have same volumes.

23. The microfluidic device of claim 22, wherein the exit valves are capillary valves configured to open at different revolving speeds of the rotatable disk type platform.

24. The microfluidic system of claim 16, wherein a valve or a valve group, which independently open and closes the diluted solution chambers, is installed in each of the flow paths connected from the middle exit of the mixing chamber to the diluted solution chambers.

25. The microfluidic system of claim 24, wherein the valve or the valve group comprises a valve material in which a heating particle dispersed in a phase transition material dispersion medium which is solid at a room temperature, and a transition valve operated using an operation in which the valve material is melted by heat generated by electromagnetic waves emitted from an external energy source and moved, and the channel is opened and closed.

26. The microfluidic system of claim 25, wherein the valve group comprises a pair of phase transition valves comprising a normally closed valve and a normally open valve.

27. The microfluidic system of claim 25, wherein the phase transition material dispersion medium is at least one selected from the group consisting of wax, gel and a thermoplastic resin.

28. The microfluidic system of claim 25, wherein the diameter of the heating particle is in the range of 1 nm to 100 μm.

29. The microfluidic system of claim 25, wherein the heating particle is formed of at least one selected from the group consisting of a polymer bead, a quantum dot, an Au nanoparticle, an Ag nanoparticle, a bead with metal composition, a carbon particle and a magnetic bead.

30. The microfluidic device of claim 25, wherein the transition valve is configured to open and close a particular flow path in immediate proximity to the transition valve several times.

* * * * *